United States Patent [19]

Bateman

[11] Patent Number: 5,070,924

[45] Date of Patent: Dec. 10, 1991

[54] THERMAL DRAPERY SYSTEM

[76] Inventor: Frank E. Bateman, 282 Hill Rd., Boxborough, Mass. 01719

[21] Appl. No.: 379,251

[22] Filed: Jul. 12, 1989

[51] Int. Cl.[5] ..... A47H 1/00

[52] U.S. Cl. ..... 160/124; 160/330

[58] Field of Search ..... 160/330, 124, 123, 84.1, 160/341; 428/196, 247

[56] References Cited

U.S. PATENT DOCUMENTS

| | | | |
|---|---|---|---|
| 1,926,328 | 9/1933 | Chapman . | |
| 2,495,414 | 1/1950 | Herrington . | |
| 3,321,781 | 5/1967 | Reich . | |
| 3,594,914 | 7/1971 | Kutsahi . | |
| 4,020,826 | 5/1977 | Mole . | |
| 4,115,899 | 9/1978 | Ford . | |
| 4,167,205 | 9/1979 | Gerdeman . | |
| 4,188,991 | 2/1980 | Boyle . | |
| 4,335,774 | 6/1982 | Price | 160/DIG. 7 X |
| 4,390,055 | 6/1983 | Fenley . | |
| 4,391,865 | 7/1983 | Constance | 160/330 X |
| 4,679,609 | 7/1987 | Bateman . | |

FOREIGN PATENT DOCUMENTS

| | | |
|---|---|---|
| 1192832 | 9/1985 | Canada . |
| 2487256 | 7/1980 | France . |
| 2505373 | 11/1982 | France . |
| 2572272 | 10/1984 | France . |

OTHER PUBLICATIONS

A document entitled, "Reflective Spaces", Describes the Use of Multiple Reflective Air Spaces for Wall and Roof Insulation.

*Primary Examiner*—Blair M. Johnson

*Attorney, Agent, or Firm*—Hamilton, Brook, Smith & Reynolds

[57] ABSTRACT

An improved thermal drapery construction to provide two thermally resistant air spaces behind a decorative drapery without increasing the bulk or stack when the drapery is pulled off the glass. The construction consists of hanging a three part thermal drapery consisting of a backing material with fibrous spacer and a material metallized on two sides from a wide tape that suspends the three part combination under a carrier on a retaining rod. The combination material is slightly thinner than the carrier so an air space is created between the thermal drapery and a decorative drapery that is attached to the opposite side of the same carrier. The air space between the two draperies is also increased by a recalculation of the spacing of the carrier fastening means on the headings of the two draperies.

A critical feature of the thermal drapery is the means of assembly that makes it fold in regular reverse folds so that it enhances the appearance of the folds of the outer drapery. The means of assembly also allows the material to be uniformly opaque.

Additional improvements have been made to the heat-cap and support brackets to facilitate installation of the heat cap and retainer rod or rods. The thermal drapery has a design feature that allows a sheer curtain to be hung behind the drapery with no danger of the outer drapery crushing the inner when the outer drapery is opened and closed.

23 Claims, 7 Drawing Sheets

THERMAL DRAPERY SYSTEM

FIELD OF THE INVENTION

In the field of insulation of buildings it has recently been discovered that up to 80% of the heat loss occurs by radiation. An air space bounded by at least one surface which is highly reflective to heat rays is called a reflective air space. The surface that faces the heat absorbs 3% of the heat and reflects 97%, so only one surface of a reflective air space needs to be reflectant. Placing two reflectant air spaces back to back provides the maximum practical insulation for heating and cooling.

It would be dramatically beneficial to the conservation of energy in the United States if this new information could be incorporated in an aesthetically acceptable form to deal with heat loss through large glass areas because people would use it. Billions of square feet of large single glazed windows were installed in buildings built prior to 1973. Millions of energy dollars are being wasted in an attempt to heat and cool these interiors.

The majority of hotels and motels in the United States install a sheer curtain for privacy. Being able to prevent the drapery and sheer from abrading and soiling each other as the drapery is opened and closed will reduce cleaning bills and extend the time of replacement.

SUMMARY OF THE INVENTION

The chief object of the present invention relates to the method of manufacturing an insulating fabric that creates two reflective spaces and yet permits reverse folds.

A second object of the invention is to provide the means to hang the fabric behind a drapery without increasing the apparent bulk when the drapery is opened.

A third object is to provide a means of maintaining a reflective space from the top of the drapery to the bottom of the hem while enhancing the reverse folds.

A fourth object of the invention is to cause the thermal drapery to hang slightly away from the wall at the bottom so that when the drapery is opened and closed it will not touch a sheer curtain hanging behind.

A fifth object of the invention is to provide a convenient mean of installation of a heat cap and retaining rods simultaneously.

DETAILED DESCRIPTION OF THE INVENTION

Figure 1:
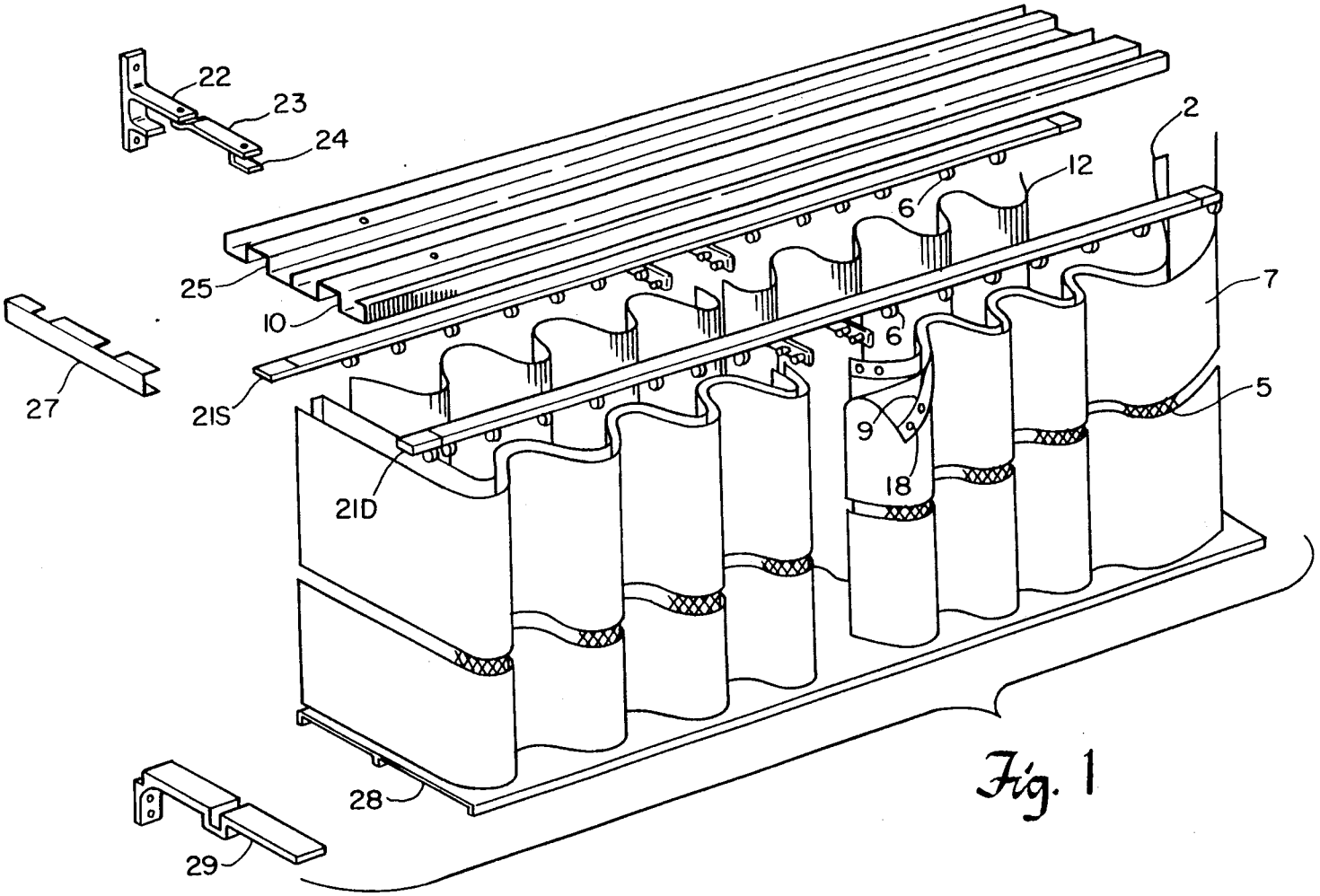
FIG. 1 is an exploded view of the total assembly showing a sheer curtain behind the thermal drapery which hangs from the same carriers as the decorative drapery, the heat cap with retaining rods, the special bracket to facilitate installation of the cap and rods, and a convectance shelf and bracket.

FIG. 1 shows a sheer curtain, 12, which would be suspended by a carrier, 6, suspended in a retaining rod, 21s, which would be inserted in sheer heat-cap, 25. In front of the sheer is the thermal drapery made up of knit fabric, 2, joined to a metallized material, 5, having a special tape at the top, 1, which fastens to one side of a carrier, 6, suspended by retaining rod, 21D, which would be inserted in heat-cap, 10. The decorative fabric, 7, is suspended by a woven tape, 9, having fasteners that attach to the opposite side of the carriers, 6, which are suspended by the retaining rod, 21D.

The installation bracket, 22, has an extension, 23, which supports the two heat cap retaining rod assemblies when a sheer curtain is to hang behind the thermal drapery. The support clip, 24, is designed to catch the front edge of the thermal drapery heat cap, 10, whether it is attached to support bracket, 22, for single installation, or attached to the extension, 23, for double drapery installation.

A convectance shelf, 28, is shown in place to prevent heat from going behind the thermal drapery system when a short drapery is desired. A convectance shelf support, 29, keeps the shelf in close proximity to the bottom of the drapery.

Figure 2:
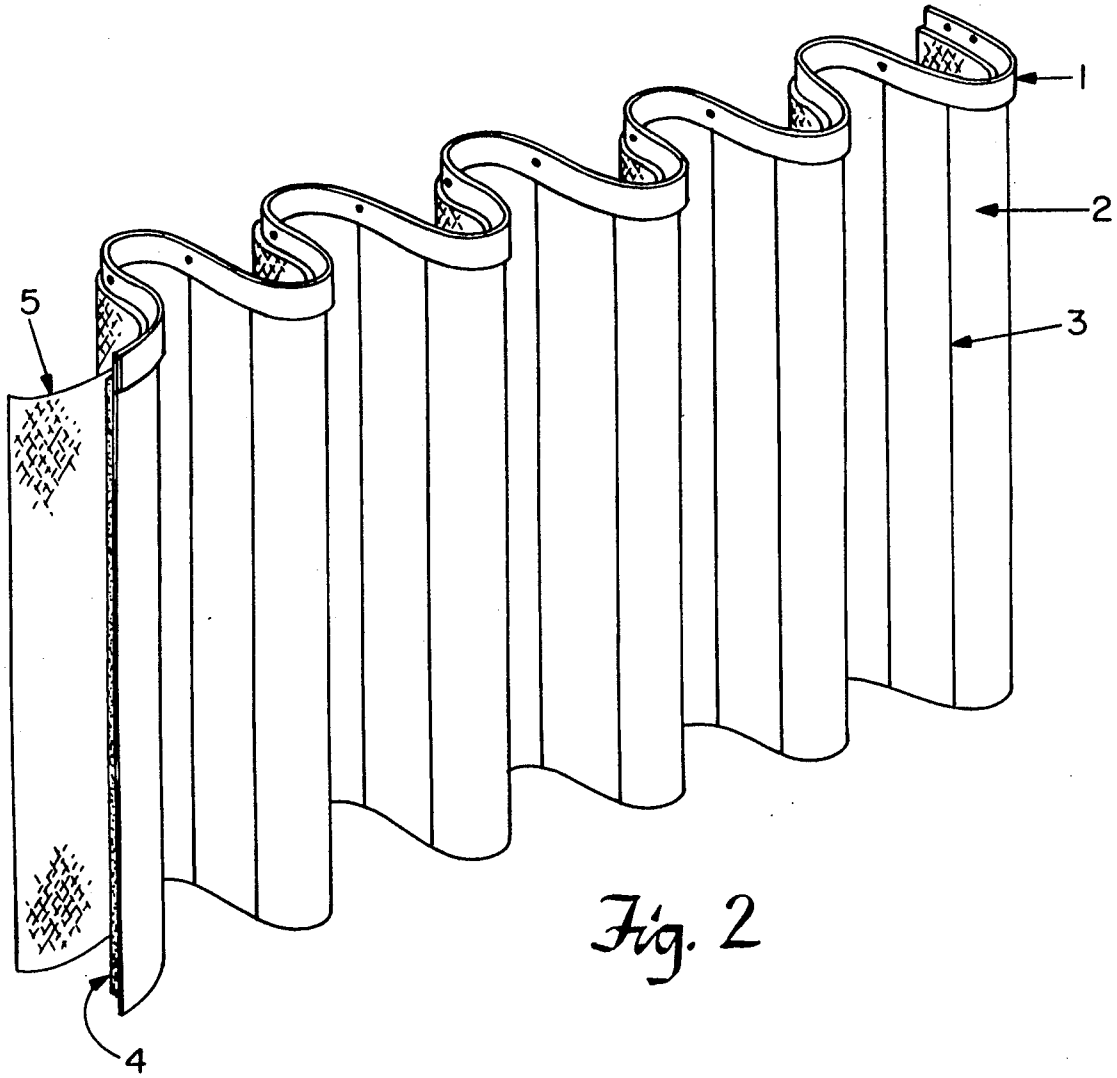
FIG. 2 is a rear view of the thermal drapery showing the three materials, means of assembly and special tape for suspending it under the carriers on the retaining rod used to support the drapery.

FIG. 2 shows the essential elements of the thermal drapery fabric seen from the back side. A wide tape, 1, is attached to the top of the three layer material that creates the reflective air space. The fabric, 2, is attached to a fibrous spacer, 4 A material metallized on two sides, 5, has been joined to the fabric, 2, by means of adhesive lines, 3 which are spaced apart in a specific relationship to the fasteners, 14, on tape, 1.

Figure 3:
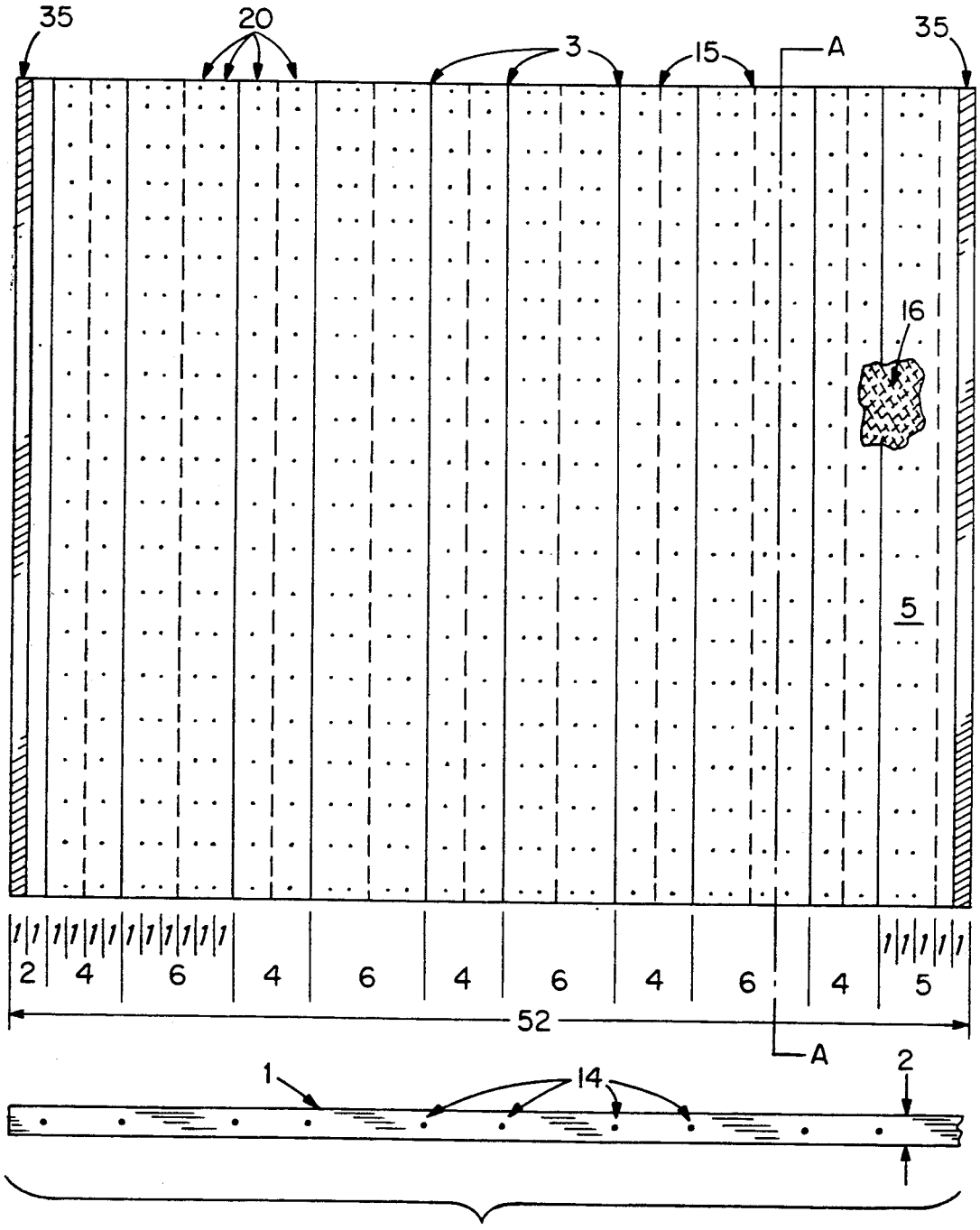
FIG. 3 is an elevation of the thermal drapery showing the spacing of the lines joining the layers of material and the related location of fasteners on the special tape.

FIG. 3 is a plan view of a preferred pattern of adhesive lines, 3, on the material metallized on two sides, 5, and their relationship to the spacing of the fasteners, 14, on the tape, 1. The four inch spaces are divided into four equal parts by three adhesive lines; the center line establishes the fold line, 15, of the fabric when the fasteners are moved together or apart on the carriers and the intermediate lines, 20, keep the metallized material, 5, in contact with the fibrous spacer between the fastener location and the fold line. Six inch spaces are divided into six parts by five adhesive lines to establish the fold line, 15, in the center and four intermediate adhesive lines, 20, which keep the metallized material in contact with the fibrous spacer between the fastener location and the fold line when the fasteners are moved together or apart. Adhesive is used to join the metallized material through the fibrous spacer to the fabric so no perforations or thin spots are made in the thermal drapery to allow light to penetrate.

The metallized material, such as polyester film, has been crinkled, 16, to permit the film to contract and stretch when the carriers move together or apart. Additional adhesive lines could be added to further secure the metallized material.

In an alternative embodiment, line lamination of a woven or knitted fabric with a material metallized on one side can make a thermal drapery with one reflective air space between the thermal drapery and the decorative drapery.

To create successful folds, the adhesive is applied to the fibrous side of fabric and the metallized material is pressed on to bond the fabric, spacer and film.

The side hems, 35, are made by securing the metallized material to the knit material and fibrous spacer by a solid line of adhesive. The side hems can then be joined by coating one hem with adhesive and then pressing the other on top. The seam will then be located midway between a foldline and a line intersecting a fastening point on the tape.

Figure 4:
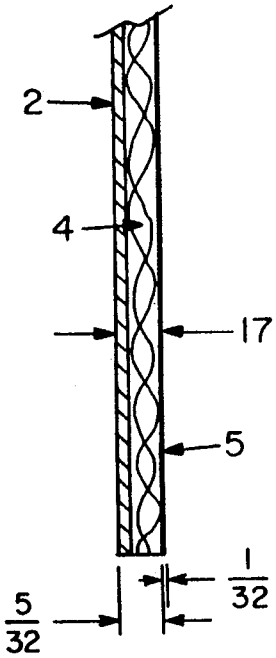
FIG. 4 is a full size section through A—A on FIG. 3 showing the fabric, fibrous spacer and double metallized material.

FIG. 4 is a preferred embodiment of the movable reflective space with specific dimensions. The fabric, 2, has a fibrous spacer affixed, 4, which separates the metallized material from the fabric to create a reflective air space, 17. A drapery fabric with spacer attached can be manufactured by stitch knitting a fibrous spacer on a knit base, heat setting the product to eliminate stretch and then relaxing the fibers by immersion in water or loose steaming as with woolen tweeds.

Figure 5:
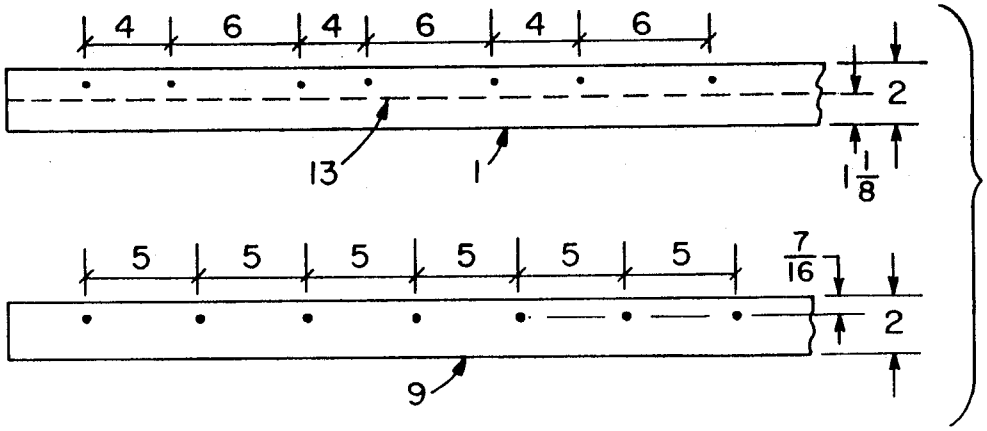
FIG. 5 is a plan view of the two tapes used to support the thermal drapery and the decorative drapery with their preferred fastener spacings.

FIG. 5 is the plan view of the tape for the decorative fabric, 9, which has fasteners spaced even distances apart and the tape for the thermal drapery, 1, which has fasteners spaced compensating distances apart to allow it to fold a predetermined distance inside and outside the folds of the decorative fabric tape. A light colored line, 13, is to be woven into the thermal drapery tape, 1, to indicate the position of the thermal drapery attachment to the tape. These tapes are to be woven of a heavy enough construction to allow them to function as both the means of suspension and stiff enough to be used in a drapery construction to form the reverse folds at the top without the need of a heading material such as buckrum. If a light weight tape is desired, it must be stiffened by a coating to give it the ability to force the reverse folds of this drapery construction without folding in sharp creases at the top.

Figure 6B:
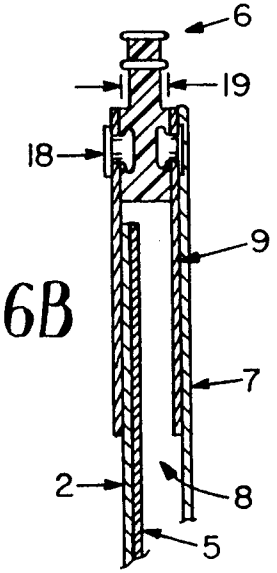
FIG. 6*b* is a section through one of the carriers showing the location of the tapes and an alternate embodiment of the thermal drapery omitting the fibrous spacer and thereby creating one reflective air space.
Figure 6A:
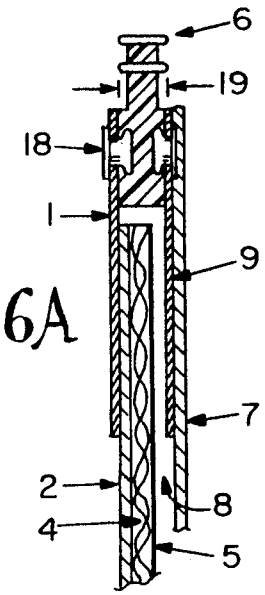
FIG. 6*a* is a section of the preferred drapery assembly through one of the carriers showing the location of the tapes and the three part thermal drapery construction that creates two reflective air spaces.

FIG. 6*a* shows how the preferred thermal drapery composed of a fabric, 2, with a fibrous spacer, 4, and a metallized material, 5, hangs under a carrier, 6, by means of a wide tape, 1, which is attached to the carrier by means of a snap, 18. Only the thickness of the drapery tape, which is approximately 1/32", is required between adjacent carriers because the bulk of the thermal drapery, approximately ¼", is under the carrier. A decorative fabric, 7, is attached to the carrier by a tape, 9, which holds the decorative fabric away from the metallized material, 5, part of the width of the carrier, 19, plus the thickness of the tape to create the second reflective space, 8. The first reflective air space is created by the thickness of the fibrous spacer. The preferred width of the carrier is 0.25" or more.

FIG. 6*b* shows how an alternate thermal drapery composed of a fabric, 2, attached to a metallized material, 5, hangs under a wide tape, 1, which is attached to the carrier, 6, by means of a snap, 18. A decorative fabric, 7, is attached to the carrier, 6, by a wide tape, 9, which holds the decorative fabric away from the metallized material, 5, part of the width of the carrier, 19, plus the thickness of the tape to create one reflective air space, 8. The preferred width of the carrier is 0.25 or more.

Figure 7:
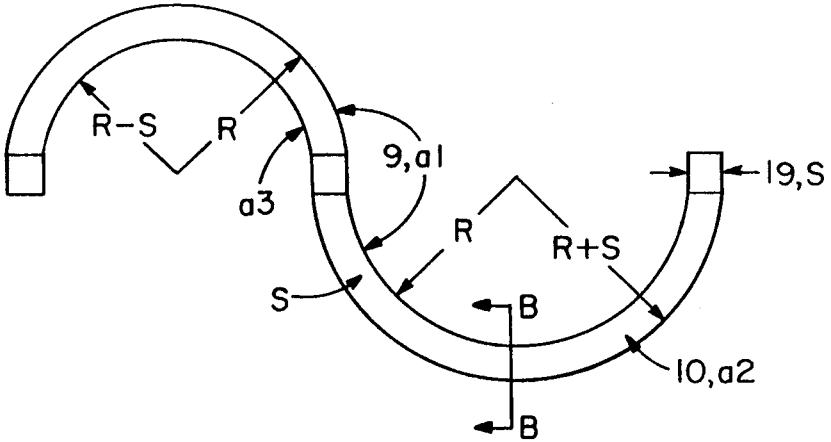
FIG. 7 is a diagram of the relationship between the arcs of the reverse folds of the thermal drapery and the arcs of the decorative drapery that causes the thermal drapery to push the decorative fabric away from the wall at the bottom.

FIG. 7 illustrates the relationships between the arcs formed by the two tapes when affixed to carriers equidistances apart on a retaining rod. The formula for the arcs of the decorative drapery is $a1 = pi \times R$. The formula for the thermal drapery arcs are, for the greater $a2 = pi \times (R + S)$, and for the lessor $a3 = pi \times (R - S)$. S = the width of the carrier, 19, in FIG. 6 and FIG. 7. If the width of the carrier is 0.25", and al is set at 5", it is possible to calculate the corresponding arcs, a2 and a3.

$$a1 = pi \times R, soR = a1/pi, R = 5/3.14, R = 1.59''$$

$$a2 = pi \times (R + S), soa + 2 = 3.14 \times (1.59 + 0.25-), a2 = 5.78''$$

$$a3 = pi \times (R - S), soa3 = 3.14 \times (1.59 - 0.25), a3 = 4.21''$$

To make certain that the reflective space is maintained at the heading of the panels, a2 is increased to 6.0" and a3 is reduced to 4.0". The result of this difference in a2 and a3 is a 33% difference in the weight of the material in the two arcs. The increase in the weight of a2 puts a moment of force on the snap fasteners, 18, FIG. 6 acting as a pivot on carrier, 6, FIG. 6 which causes a2 of the thermal drapery to swing downward pushing al of the decorative drapery approximately 1"forward at the bottom.

Figure 8:
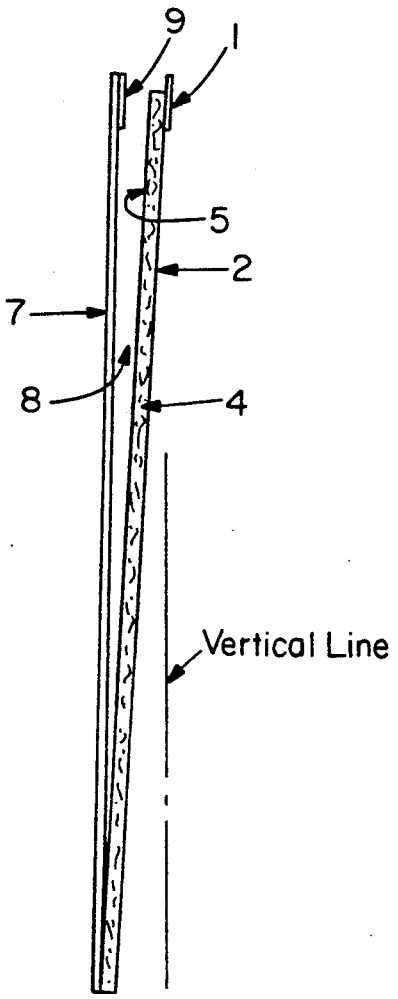
FIG. 8 illustrates how the increased weight of the larger arc of the thermal drapery acting on the carriers causes the thermal drapery to contact the decorative drapery at the bottom to push it slightly toward the room.

FIG. 8 is a cross section through BB in FIG. 7. The reflective air space is shown to be tapered from top to bottom due to the weight of the outer arc of the thermal drapery swinging the bottom hem forward into contact with the decorative drapery, 7. The adhesive lines joining the thermal drapery elements (knit, fibrous spacer and metallized material, numerals 2, 4, 5), keep the fabric straight in the vertical direction but allow the fabric to fold in the horizontal direction.

Figure 9:
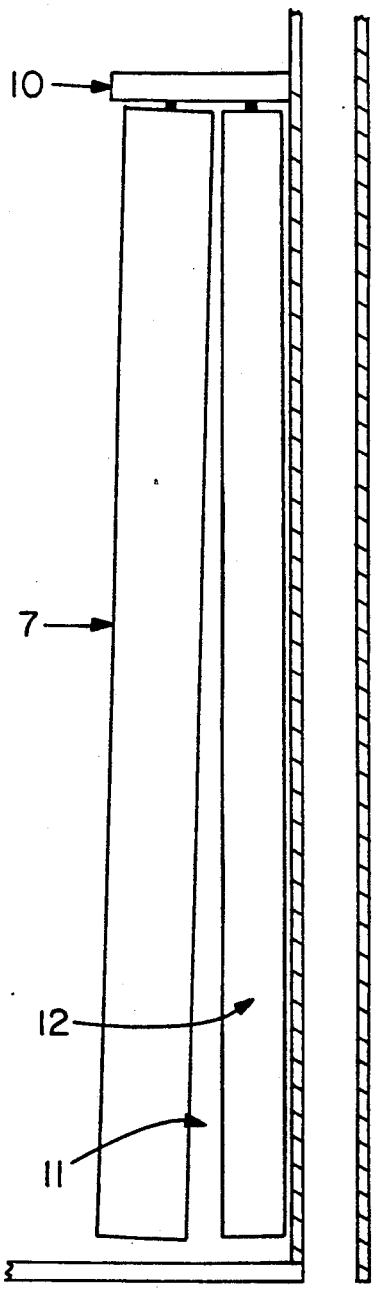
FIG. 9 is a side view of the thermal drapery and decorative drapery assembly hanging in front of a sheer curtain showing the increased space between the assembly and the sheer at the bottom.

FIG. 9 shows how the decorative drapery, 7, has been pushed forward to create greater clearance, 11, between the bottom of the drapery and the sheer curtain, 12. To be certain that the sheer curtain hangs vertically, the heading of the curtain should be attached to a tape having fasteners spaced equal distances apart so the inner and outer arcs are of equal length and weight.

Figure 10:
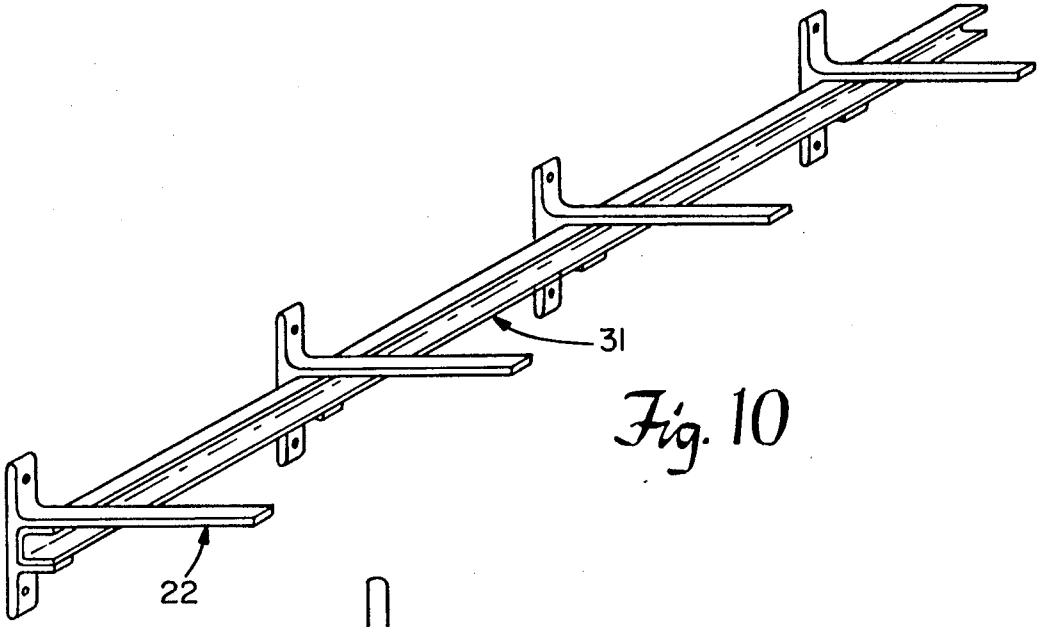
FIG. 10 shows the installation accessory as it is used to align the special brackets on the wall.

FIG. 10 shows the installation alignment tool which is to be made of extruded aluminum in 3', 4', 5', 6'lengths with a 3"splice on the end of each section to allow assembly for 8', 9', 10', 11', 12', 13', 14', 15', 16'installations. Right and left brackets would be installed by measure. The tool would have a press fit so intermediate brackets could be mounted the correct distance apart. The tool with brackets attached would then be pressed into the end brackets and the intermediate brackets would be held in place to be fastened to the wall in perfect alignment. The installation tool is then removed and the heat-cap retaining rod assembly can then be mounted.

Figure 11:
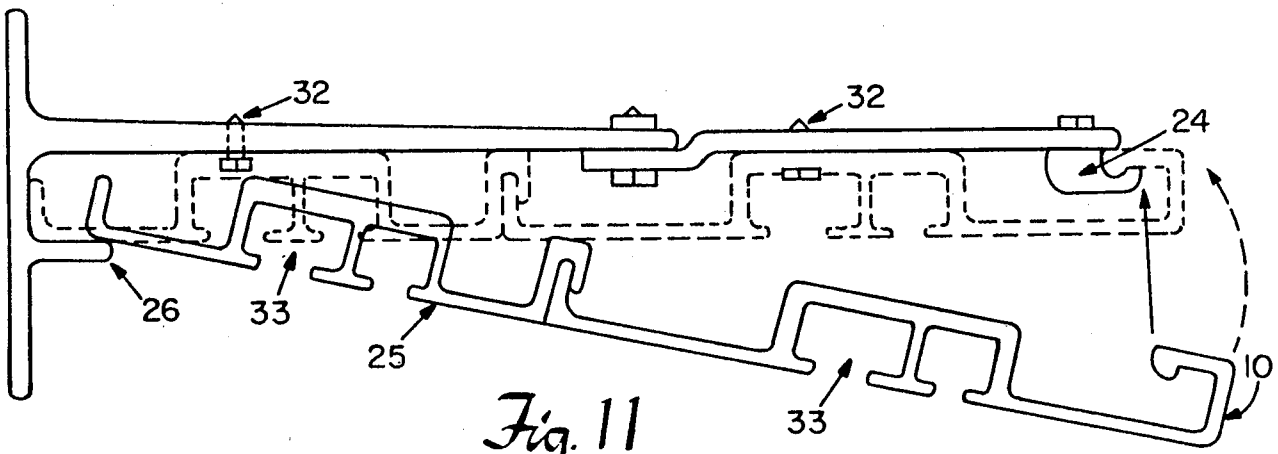
FIG. 11 illustrates how the bracket supports the heat-cap and retaining rod assembly during installation.

FIG. 11 illustrates how the heat cap assembly rests on the heat-cap installation support, 26, and is then raised so that the outer edge of heat-cap, 10, comes slightly above the support clip, FIG. 24. The assembly is then pressed toward the wall mounting the heat-cap assembly front and rear. The retaining rods are then fastened to the brackets by self-tapping screws, 32, inserted through the top of the cord track, 33.

Figure 12:
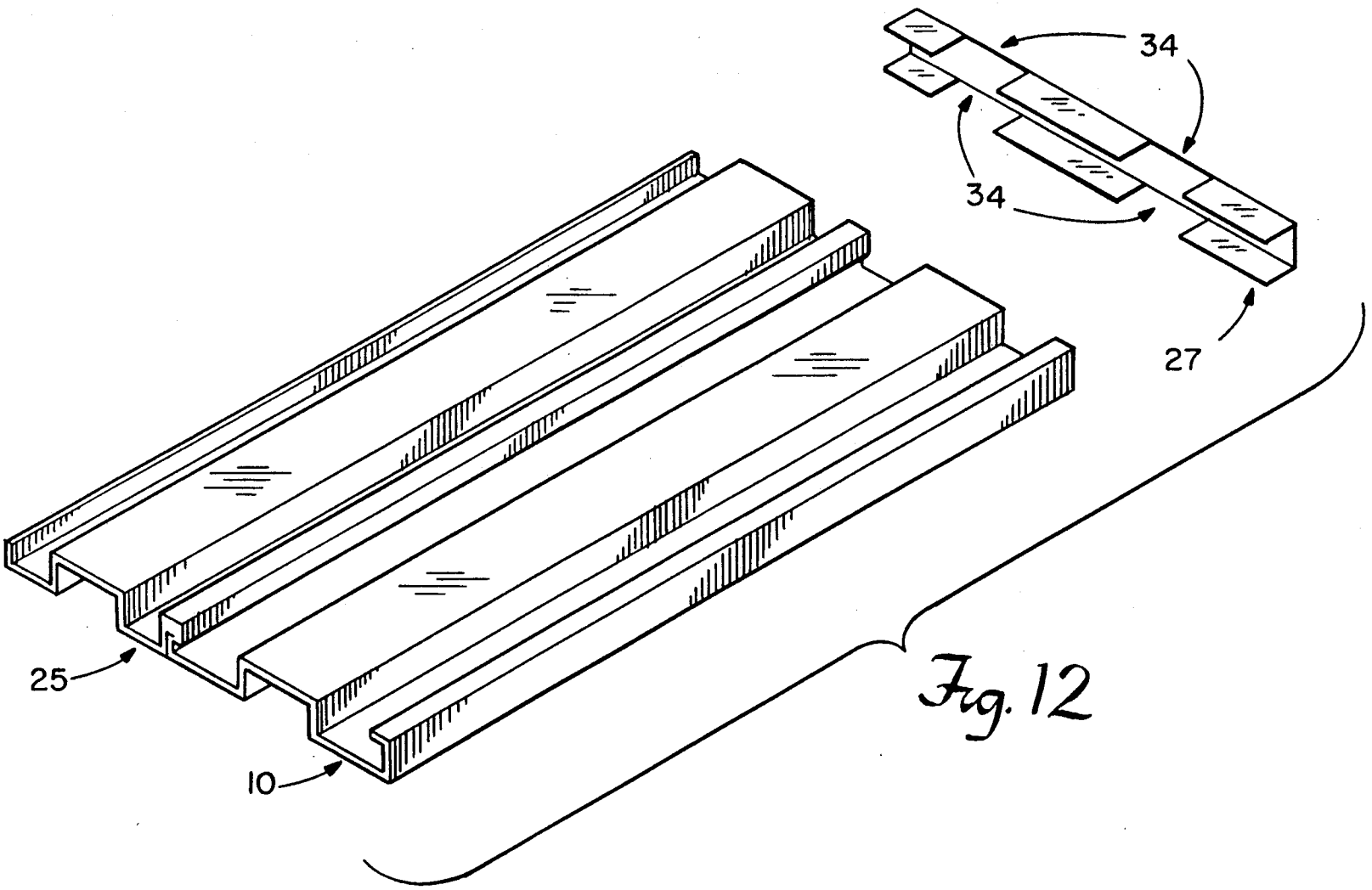
FIG. 12 shows the heat-cap for the sheer joined to the heat-cap for the thermal drapery with an end cap adjacent.

FIG. 12 pictorially demonstrates the heat caps assembled with the universal end cap, 27, ready to slide on either the right or left end of the heat-caps. The cutouts top and bottom of the end caps, 34, permit the pulley housing of the retaining rod to be exposed under the heat-caps.

I claim:

1. A thermal drapery system comprising:

a carrier assembly;

an outer drapery secured to one side of the carrier assembly;

a thermal drapery secured to the carrier assembly on a side opposite the outer drapery, the thermal drapery comprising a fabric secured to the carrier, a fibrous spacer secured to the fabric between the fabric and a heat reflective material metallized on two sides that is secured to the fibrous spacer with a patterned adhesive arranged in spaced parallel lines such that a first reflective space is formed by the fibrous spacer between the metallized material and the fabric and a second reflective space is formed by a spacing between the metallized material and the outer drapery, the thermal drapery system being periodically foldable along the spaced parallel lines.

2. The thermal drapery system of claim 1 wherein adjacent adhesive lines are equally spaced.

3. The thermal drapery system of claim 1 wherein the adhesive extends along lines between adjacent fasteners that secure the thermal drapery to the carrier.

4. The thermal drapery system of claim 1 wherein the thermal drapery is mounted on one side of the carrier assembly and is positioned underneath the carrier assembly.

5. The thermal drapery system of claim 1 wherein the thermal drapery hangs at an angle relative to a vertical axis extending through carrier.

6. The thermal drapery system of claim 1 wherein the fabric is knitted, heat set and treated with water or steam to form a drapeable material.

7. The thermal drapery system of claim 1 wherein the fabric is stitch knit with the fibrous spacer secured to the fabric.

8. The thermal drapery system of claim 1 wherein the metallized material comprises a polyester film.

9. The thermal drapery system of claim 1 wherein the intrinsic stress of the metallized material has been relieved by crinkling.

10. The thermal drapery system of claim 1 further comprising fasteners to secure the outer drapery and the thermal drapery to the carrier.

11. The thermal drapery system of claim 1 further comprising fasteners that secure the thermal drapery to the carrier such that the fasteners are positioned along at least some of the parallel lines.

12. The thermal drapery system of claim 1 wherein the thermal drapery and the outer drapery are secured to the carrier with a tape.

13. The thermal drapery system of claim 10 wherein the fasteners are snap fasteners.

14. The thermal drapery system of claim 5 further comprising an inner panel suspended by a second carrier assembly extending parallel to the carrier assembly such that the thermal drapery hangs at an angle away from the inner panel.

15. The thermal drapery system of claim 1 wherein the metallized material is secured to the fabric with an adhesive extending through the fibrous spacer.

16. The thermal drapery system of claim 12 wherein said tape comprises a webbing which causes a plurality of headings into reverse folds.

17. A thermal drapery system comprising:

a carrier assembly;

an outer drapery secured to one side of the carrier assembly;

a thermal drapery secured to the carrier on a side opposite the outer drapery and suspended beneath the carrier, the thermal drapery comprising a fabric panel and a metallized material secured to the panel with an adhesive distributed between the panel and the material in spaced vertical lines.

18. The thermal drapery system of claim 17 further comprising fasteners to secure the thermal drapery to the carrier such that the fasteners are positioned along the vertical lines.

19. The thermal drapery system of claim 17 wherein the thermal drapery and the outer drapery are positioned in spaced apart relationship to form a thermally reflective cavity.

20. The thermal drapery system of claim 17 further comprising an inner panel suspended vertically from a second carrier assembly and located on a side of the thermal drapery opposite the outer drapery such that the thermal drapery is suspended at an angle away from the inner panel.

21. A thermal drapery system comprising:

a carrier assembly;

an outer drapery secured to one side of the carrier assembly;

a thermal drapery secured to the carrier assembly on a side opposite the outer drapery, the thermal drapery comprising a fabric secured to the carrier, a fibrous spacer secured to the fabric between the fabric and a metallized heat reflective material that is secured to the fibrous spacer with an adhesive such that a first reflective space is formed by the fibrous spacer between the metallized material and the fabric and a second reflective space is formed between the metallized material and the outer drapery, the metallized material being crinkled to provide a flexible thermal drapery.

22. The thermal drapery system of claim 21 wherein the metallized material reflects at least 97% of any heat transmitted through the first or second reflective spaces.

23. The thermal drapery system of claim 21 wherein the metallized material is unperforated.

* * * * *